US007131918B1

(12) United States Patent
Prince

(10) Patent No.: US 7,131,918 B1
(45) Date of Patent: Nov. 7, 2006

(54) BASEBALL GAME AND PLAYING FIELD

(75) Inventor: Lyndonn Prince, New York, NY (US)

(73) Assignee: Fastball; Twice the Action. . . Half the Time Inc., New York, NY (US)

( * ) Notice: Subject to any disclaimer, the term of this patent is extended or adjusted under 35 U.S.C. 154(b) by 0 days.

(21) Appl. No.: 10/988,482

(22) Filed: Nov. 15, 2004

Related U.S. Application Data

(60) Provisional application No. 60/554,120, filed on Mar. 18, 2004.

(51) Int. Cl.
*A63B 67/00* (2006.01)

(52) U.S. Cl. ..... 473/468

(58) Field of Classification Search ..... 473/468, 473/415, 422; 273/317.6, 108, 108.3
See application file for complete search history.

(56) References Cited

U.S. PATENT DOCUMENTS

| | | | | |
|---|---|---|---|---|
| 1,120,076 A | | 12/1914 | Noonan | |
| 1,911,569 A | | 5/1933 | Hinckley | |
| 3,024,024 A | * | 3/1962 | Chalcroft | 473/468 |
| 4,037,837 A | | 7/1977 | Bauer | |
| 4,211,413 A | | 7/1980 | Arzola | |
| 4,781,385 A | * | 11/1988 | Harley | 473/468 |
| 4,973,061 A | * | 11/1990 | Catherall | 473/468 |
| 5,906,553 A | | 5/1999 | Carrocio | |
| 6,179,734 B1 | | 1/2001 | Bravard | |
| 2003/0176243 A1 | * | 9/2003 | Joseph et al. | 473/415 |
| 2004/0138014 A1 | | 7/2004 | Lister | |

OTHER PUBLICATIONS

Webpage download, QCBaseball, 2003,http://www.qcbaseball.com/skills/playingcatch1.aspx, 2 pages.*
Webpage download, The Bronx Beat, Apr. 2, 2001, http://www.jrn.columbia.edu/studentwork/bronxbeat/2001/040201/baseball0402_01.html , 1 page.*
WebPage download, Bodybuilding.com, May 8, 2004,www.bodybuilding.com/fun/eteam30.htm,7 pages.*
Miller, Grady L.. *Baseball Field Layout and Construction*, University of Florida, Institute of Food and Agricultural Sciences, Published: Jun. 2001, Revised: Jul. 2001.

* cited by examiner

*Primary Examiner*—Eugene Kim
*Assistant Examiner*—M. Chambers
(74) *Attorney, Agent, or Firm*—Seth Natter; Natter & Natter

(57) ABSTRACT

An improved baseball game reduces idle time between successive pitches by having two pitchers pitch sequential pitches to two batters. The pitchers are stationed at two spaced pitching mounds on one playing field and the batters are positioned in spaced batters boxes, each with an associated batter's plate.

14 Claims, 1 Drawing Sheet

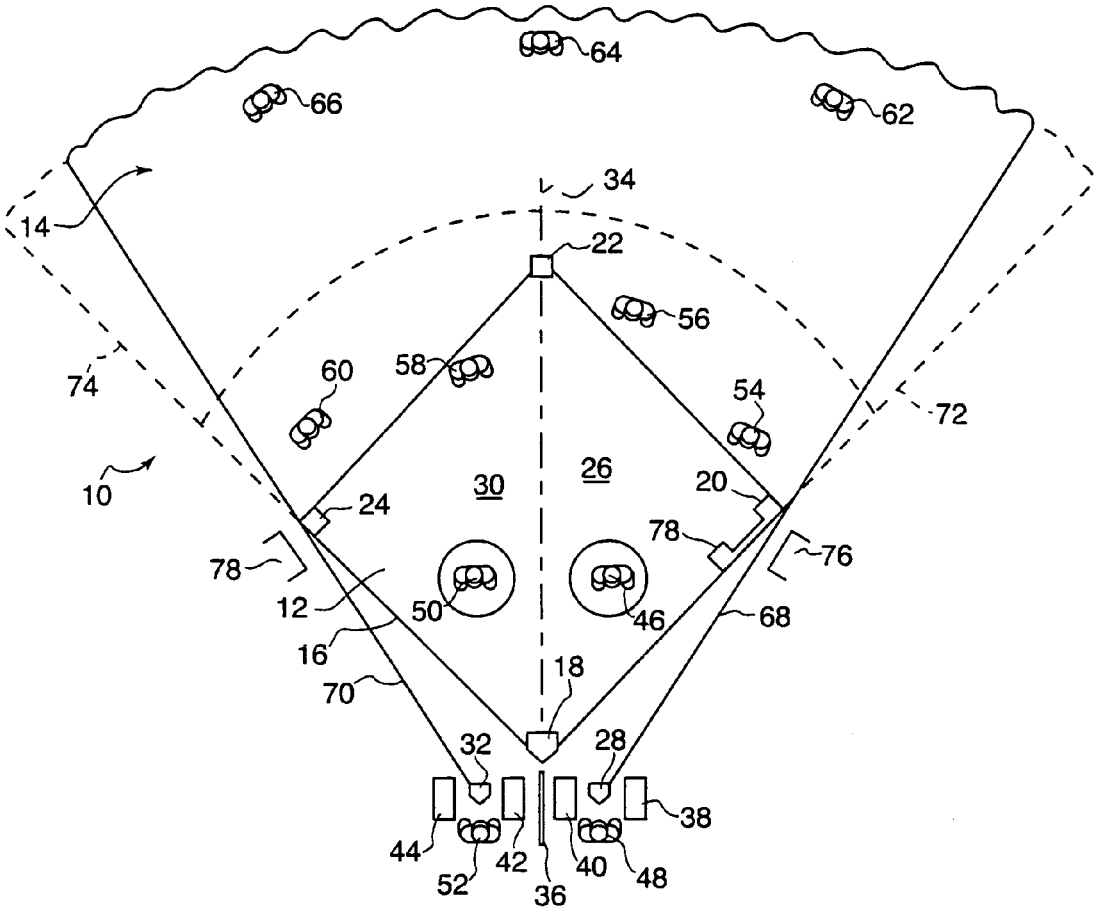
64
66
62
34
14
22
56
74
60
58
54
72
10
30
26
20
24
78
76
78
12
50
46
68
16
18
70
32
28
38
44
42
40
48
52
36

BASEBALL GAME AND PLAYING FIELD

RELATED APPLICATION

This application claims the benefit of U.S. Provisional Application Ser. No. 60/554,120 filed Mar. 18, 2004.

BACKGROUND OF THE INVENTION

1. Field of the Invention

The present invention relates generally to the sport of baseball and more particularly to an improved game and playing field wherein the pace of play is increased.

2. Antecedents of the Invention

Baseball has been an integral component of American culture for more than a century. Walt Whitman's 1855 epic, *Leaves of Grass*, foretold the significance of this sport: "*I See Great Things in Baseball, It's Our Game—The American Game*".

While baseball has gained immense popularity since its inception, the popularity of the sport in recent years has declined. Among young sports fans, games having a more accelerated pace such as basketball have eroded some of the popularity of baseball. The decline in favor of more exciting games is believed to be attributable, in part, to the pace and length of professional baseball games.

In a March 2002 CNN/USA Today/Gallup Poll, 29% of baseball fans indicated that major league baseball games were too long and 31% of the fans indicated specifically that the length of time between pitches was an annoyance.

A baseball commentator has indicated that one of the best ways to complete a game in less than 3 hours is to have pitchers work more efficiently. By cutting the pitch count from 285 pitches to 270 pitches would reduce playing time by approximately 9 minutes and bring the average playing time down to 2 hours, 47 minutes.

Attempts have been suggested to increase the pace of baseball by raising the pitcher's mound to 13" above home plate, rather than the standard 10½", in order to shorten the game and make pitches more difficult to hit.

It has also been considered to shorten the time between innings and reduce the number of warm-up pitches to quicken the pace of the game.

By reducing the 15 to 20 second idle time between successive pitches, which can account for up to an hour of a 3 hour game, the length of a baseball game can be reduced considerably and the pace of the game increased to provide a more enjoyable experience for spectators.

SUMMARY OF THE INVENTION

An improved baseball game reduces pitcher preparation time between successive pitches by having two pitchers pitch sequential pitches to two batters while one pitcher is preparing to pitch to one batter, the other pitcher is pitching to the other batter. The pitchers are stationed at separate pitching mounds on one playing field and the batters are positioned at separate batter's plates.

Each batter's plate is positioned rearwardly of a conventional home plate on a baseball diamond and is spaced equidistantly from an axis extending between home plate and second base.

Each pitcher's mound is spaced equidistantly from the axis.

An impact absorbing screen may be positioned along the axis between the batter's plates to protect a batter who is not receiving a pitch from injury due to foul balls and thrown bats.

In accordance with the invention, the defensive team on the playing field, with two pitchers and two catchers comprises 11 players.

In the foregoing compendium, it will be appreciated that it is an aspect of the present invention to provide a baseball game and playing field which is not subject to the disadvantages of the aforementioned antecedents of the invention.

It is a feature of the present invention to provide a baseball game of the general character described wherein a baseball type game is played at a faster pace than previously known.

It is a consideration of the present invention to provide a baseball game of the general character described having reduced idle time between successive pitches.

Another aspect of the present invention is to provide a baseball game of the general character described with shortened overall game play duration.

A further feature of the present invention is to provide a baseball game of the general character described with increased spectator interest.

Another consideration of the present invention is to provide a baseball playing field of the general character described having a plurality of pitching mounds and a like plurality of batter's plates.

Yet another aspect of the present invention is to provide a baseball game of the general character described which minimizes spectator boredom with game play.

A still further feature of the present invention is to provide a baseball game of the general character described with heightened excitement.

Other aspects, features and considerations of the present invention in part will be obvious and in part will be pointed out hereinafter.

With these ends in view, the invention finds embodiment in the various combinations of elements, arrangement of parts and series of steps by which the aforesaid aspects, features, and considerations are attained, all with reference to the accompanying drawings and the scope of which will be more particularly pointed out and indicated in the appended claims.

BRIEF DESCRIPTION OF THE DRAWINGS

In the accompanying drawing there is shown one of the various possible exemplary embodiments of the invention comprising a plan view of a baseball playing field and illustrating a pair of spaced pitcher's mounds and a corresponding pair of batter's plates which are positioned behind a conventional home plate.

DESCRIPTION OF THE PREFERRED EMBODIMENTS

The Playing Field

Referring now in detail to the drawings, the reference numeral 10 denotes generally a playing field constructed in accordance with and embodying the invention. The playing field comprises an infield 12, and an outfield 14. The infield 12 includes a conventional baseball diamond 16 having a home plate 18, a first base 20, a second base 22 and a third base 24. The specifications, including dimension and layout of baseball fields are found in *Baseball Field Layout and Construction*, by Grady L. Miller, ENH 159, Institute of Food and Agricultural Sciences, University of Florida, Published June 2001, Revised July 2001. Such specifications are incorporated herein by reference.

Pursuant to the invention there is additionally provided a right pitcher's mound 26 registered with a right batter's plate 28 and a left pitcher's mound 30, registered with a left batter's plate 32. The batter's plates 28, 32 are spaced behind the home plate 18 a distance of approximately 12 feet and the distance between each batter's plate and a rubber of a corresponding pitcher's mound is in accordance with the incorporated specifications.

The overall layout of the baseball diamond 16 is substantially symmetrical about an axis 34 such that the right and left pitchers' mound 26, 30 are equidistantly spaced from the axis 34 as are the right and left batters' plates 28, 32.

A flexible screen 36 in the order of six feet by six feet is positioned behind home plate in the axis 34 and separates the right batter's plate 28 from the left batter's plate 32 to avoid injury to a batter from foul balls, thrown bats and the like. The screen 36 is sufficiently flexible to absorb impact from a catcher running to catch a foul ball.

The batter's plate 28 includes a pair of batter's boxes 38, 40 while the batter's plate 32 includes a pair of batter's boxes 42, 44.

In accordance with the invention, the defensive team comprises 11 members on the playing field, a right pitcher 46 pitching from the right mound 26, a right catcher 48 positioned behind the batter's plate 28, a left pitcher 50, and a corresponding left catcher 52, a first baseman 54, a second baseman 56, a shortstop 58, and a third baseman 60.

In the outfield, there are positioned, in a conventional manner, a right fielder 62, a centerfielder 64 and a left fielder 66.

There may be provided a right foul line 68 which extends from the right batter's plate 28 and crosses the corner of first base 20. Similarly, a left foul line 70 extends from the batter's plate 32 and crosses a corner of third base 24. Optionally, the right foul line may extend along the conventional diamond line from first base 20 as shown in the dashed line optional foul line 72 and the left foul line may extend from the conventional diamond as shown by the dashed line 74.

There may also be provided a first base coaching box 76 and a second base coaching box 78.

From an observation of the drawing figure, it will be noted that the distance between the first base 20 and the right batter's plate 28 is less than the distance between the first base 20 and the left batter's plate 32. Such difference can be accommodated through a first base extension 78 which is positioned forwardly of the first base 20 a distance along the foul line 72, or along the foul line 68. The first base extension 78 is effective only for the batter batting at the left batter's plate 32.

The Rules of Play

The baseball game of the present invention is played generally employing the rules of conventional baseball, except as noted otherwise herein. As with conventional baseball, the game is played between two teams having 11, rather than 9 players with the game being won by one team scoring at least one more run than the other team at the conclusion of the game.

Unlike conventional baseball, which involves one pitcher who pitches to one batter at a time, under the present invention two pitchers pitch sequentially to two batters. More specifically, the right pitcher 46 pitches a first pitch to a batter stationed in one of the batter's boxes 38, 40 at the right batter's plate 28. In the event such batter does not hit the ball into play and after the ball is thrown by the right catcher 48 to the right pitcher 46, the left pitcher 50 then proceeds with pitching a single pitch to a batter stationed in one of the batter's boxes 42, 44 associated with the left batter's plate 32.

A batter is deemed out in a conventional manner, e.g. three strikes, and a batter at the left home plate 32 need only reach the first base extension to be declared safe. He then proceeds to the first base 20, which constitutes the running base.

With respect to the first base extension 78, while a batter at the left batter's plate need run only to the first base extension 78, the first baseman 54 or any other player need only tough the first base 20 to have the batter declared out.

Because the distance between the catchers 48, 52 and the first base 20, the second base 22 and the third base 24 is greater than the distance between a catcher and such bases in a conventional baseball playing field, pursuant to the rules of play, base runners are not permitted to take a lead off a base in an attempt to steal. Each base runner must first tag the preceding base before a steal can be attempted, however, a base runner lead may be taken from the first base 20 and the second base 22 in preparation for a hit ball, a lead may not be taken off of the third base 24, since the catchers 48, 52 are not stationed immediately behind the home plate 18.

In a further aspect of the rules of play, the left catcher 52 will normally cover the home plate 18, while the right catcher 48 may participate as a backup for overthrown balls.

During regular play, each pitcher may field a ball hit by either batter, but must first drop the ball he is holding. A catcher guarding home plate is not permitted to block access to the plate from the base runner.

A further aspect of the rules of play, intentional walks are not permitted. If an umpire determines that the pitcher is attempting to intentionally walk a batter, the batter is awarded two bases.

A further aspect of the rules of play prohibit managers from stopping the game to go to the pitcher's mound. Pitchers, catchers, managers and coaches are to utilize wireless headphone communications in order to avoid delays in the game.

Another aspect of the rules of play reduces the number of warm up pitches allowed for a replacement pitcher to five.

In another aspect of the invention, if there is no winner at the end of the ninth inning of regulation play, the winner of the game is decided in a sudden death contest.

All players leave the field except for one pitcher from each team, one catcher from each team and one batter from each term. The selection of pitchers, batters and catchers is discretionary with each team.

Whichever team hits the most out of the playing field home runs or scores the most strikes over the next three batters, wins the game. If there is still a tie, the sudden death contest continues without the three-batter limitation.

During the sudden death contest, if any batter hits a ball which is not a home run, his turn at bat ends and if any batter is pitched four balls or three strikes, not including a third strike foul ball, his turn at bat terminates. A limit can be set on the number of third strike foul balls.

Among the various modifications of the game envisioned within the present invention are alternate playing field arrangements incorporating the concept of employing more than one pitcher with multiple pitchers pitching sequentially in order to reduce the delays between pitches. For example, a playing field array could include two pitchers who sequentially pitch, from spaced pitching mounds, to the same batter positioned at home plate.

Thus, it will be seen that there is provided a baseball game and playing field which achieves the various aspects, features and considerations of the present invention and which is well suited to meet the conditions of practical usage.

As various possible further embodiments might be made of the present invention and as various changes might be made in the illustrative embodiments set forth herein without departing from the spirit of the invention, it is to be understood that all matter herein described or shown in the accompanying drawings is to be interpreted as illustrative and not in a limited sense.

The invention claimed is:

1. A method of reducing the duration of playing time in a competitive baseball game between a first team and a second team on a baseball field having one infield comprising the steps of:

a) positioning a first pitcher from the first team on a first pitching mound and a second pitcher from the first team on a second pitching mound on the one infield, with the pitchers being spaced from one another, b) positioning a first batter from the second team in a first batter's box and a second batter from the second team in a second batter's box on the baseball field, facing the one infield, c) having the first pitcher pitch a first pitch to the first batter, d) having the second pitcher pitch a second pitch to the second batter, e) having the first pitcher pitch a third pitch to the first batter, and f) continuing to alternate pitchers for successive pitches.

2. A method of reducing the duration of playing time in a competitive baseball game between a first team and a second team on a baseball field having one infield in accordance with claim 1 further including the steps of:

g) positioning a first catcher from the first team and a second catcher from the first team on the baseball field, h) having the first catcher catch the first pitch and return the ball to the first pitcher prior to performing step d), and i) having the second catcher catch the second pitch and return the ball to the second pitcher prior to performing step e).

3. A method of reducing the duration of playing time in a competitive baseball game on a baseball field in accordance with claim 1 wherein the baseball field includes one outfield, the method further including the steps of:

g) positioning four infielders from the first team, three outfielders from the first team and two catchers from the first team on the baseball field.

4. A method of reducing the duration of playing time in a competitive baseball game between two teams on a baseball field comprising the steps of:

a) positioning a first pitcher from one of the teams on a first pitcher's mound and a second pitcher from the one team on a second pitcher's mound, b) positioning a first batter from the other team at a first batter's plate and a second batter from the other team at a second batter's plate, c) having the first pitcher pitch a first pitch to the first batter, d) having the second pitcher pitch a second pitch to the second batter, e) having the first pitcher pitch a third pitch to the first batter, and f) continuing to alternate pitchers for successive pitches.

5. A method of reducing the duration of playing time in a competitive baseball game on a baseball field in accordance with claim 4 wherein the baseball field includes one outfield, the method comprising the further steps of:

g) positioning four infielders from the one team, three outfielders from the one team and two catchers from the one team on the baseball field.

6. A method of reducing the duration of playing time in a competitive baseball game on a baseball field in accordance with claim 4 comprising the further steps of:

g) positioning a first catcher from the one team and a second catcher from the one team on the playing field, h) having the first catcher catch the first pitch and return the ball to the first pitcher prior to performing step d), and i) having the second catcher catch the second pitch and return the ball to the second pitcher prior to performing step e).

7. A method of reducing the duration of playing time in a competitive baseball game on a baseball field in accordance with claim 1 wherein the one infield includes a first base, a second base, a third base and at least one batter's plate.

8. A method of reducing the duration of playing time in a competitive baseball game on a baseball field in accordance with claim 7 wherein the baseball field further includes a pair of batter's plates, each of the batter's plates being positioned in registry with one of the pitcher's mounds.

9. A method of reducing the duration of playing time in a competitive baseball game on a baseball field in accordance with claim 1 further including the steps of determining a winning team where the score is tied at the end of a regular game by:

g) having a pitcher from the first team pitch to a fixed number of batters from the second team, h) terminating the second team batter's turn at bat after either striking out, hitting a nonfoul ball or walking, i) having a pitcher from the second team pitch to a fixed number of batters from the first team, j) terminating the first team batter's turn at bat after either striking out, hitting a nonfoul ball or walking, and k) determining the winning team on the basis of which team had the most out of playing field home runs or the most strikes.

10. A method of reducing the duration of playing time in a competitive baseball game between two teams on a baseball field in accordance with claim 4 including the step of positioning a screen on the axis and between the batter's plates.

11. A method of reducing the duration of playing time in a competitive baseball game between two teams on a baseball field having one infield comprising the steps of:

a) positioning a first pitcher from one of the teams on a first pitching mound and a second pitcher from the one team on a second pitching mound on the infield, with the pitchers being spaced from one another, b) having the first pitcher pitch a first pitch to a batter from the other team in a first batter's box, c) having the second pitcher pitch a second pitch to at least one batter from the other team, in a second batter's box, d) having the first pitcher pitch a third pitch, and e) continuing to alternate pitchers for successive pitches.

12. A method of reducing the duration of playing time in a competitive baseball game between two teams on a baseball field having one infield in accordance with claim 11, wherein the first pitcher pitches to a first batter from the other team and the second pitcher pitches to a second batter from the other team.

13. A method of reducing the duration of playing time in a competitive baseball game between two teams on a baseball field having one infield in accordance with claim 11 further including the steps of:

f) positioning a first catcher from the one team and a second catcher from the one team on the playing field, g) having the first catcher catch the first pitch and return the ball to the first pitcher prior to performing step c), and h) having the second catcher catch the second pitch and return the ball to the second pitcher prior to performing step d).

14. A method of reducing the duration of playing time in a competitive baseball game between two teams on a baseball field having one infield in accordance with claim 11, comprising the further step of:

f) providing an outfield; and g) positioning four infielders, three outfielders and two catchers from the one team on the baseball field.

* * * * *